United States Patent [19]

Haberlin

[11] 4,037,850

[45] July 26, 1977

[54] SKI POLE HANDLE OR THE LIKE

[76] Inventor: Paul Haberlin, Bleicherweg 52, Zurich, Switzerland, 8002

[21] Appl. No.: 624,001

[22] Filed: Oct. 20, 1975

[30] Foreign Application Priority Data

Oct. 29, 1874 Germany ..... 2451381

[51] Int. Cl.[2] ..... A63C 11/22

[52] U.S. Cl. ..... 280/11.37 H; 74/543

[58] Field of Search ..... 280/11.37 H, 11.37 B, 280/11.37 D, 11.37 L, 11.37 F, 11.37 N, 11.37 E, 11.37 R; 74/543

[56] References Cited

U.S. PATENT DOCUMENTS

| | | | |
|---|---|---|---|
| 3,181,880 | 5/1965 | Cameron et al. | 280/11.37 H |
| 3,436,090 | 4/1969 | Lange et al. | 280/11.37 H |
| 3,451,688 | 6/1969 | McDonald | 280/11.37 H |
| 3,879,048 | 4/1975 | Penney | 280/11.37 H |

FOREIGN PATENT DOCUMENTS

| | | | |
|---|---|---|---|
| 248,310 | 7/1966 | Austria | |
| 1,390,129 | 1/1965 | France | 280/11.37 H |
| 2,213,499 | 9/1972 | Germany | |

*Primary Examiner*—Joseph F. Peters, Jr.
*Assistant Examiner*—Milton L. Smith
*Attorney, Agent, or Firm*—Lane, Aitken, Dunner & Ziems

[57] ABSTRACT

A handle or handgrip for a pole, especially a ski pole, comprising a guide surface for the thumb, the metacarpus (usually referred to as the palm of the hand) and the fingers. The guide surface embodies an upright wall extending approximately in the lengthwise direction of the handle and essentially in an axial plane or a plane substantially in parallelism therewith. The upright wall prevents grasping of the handle by means of the thumb and retains the thumb together with the palm of the hand and the base of each of the fingers to one side of the handle.

8 Claims, 6 Drawing Figures

Fig.5
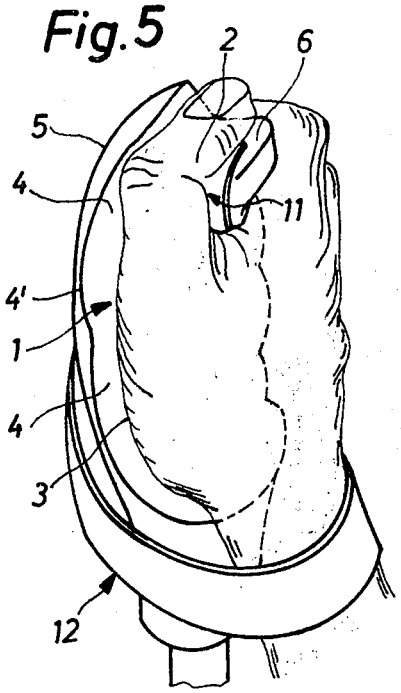
Fig.6
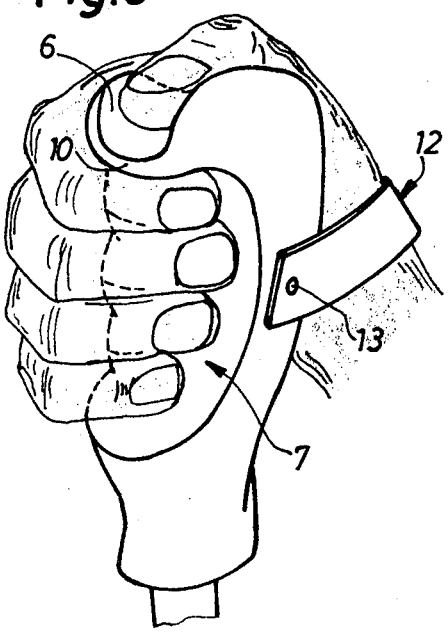
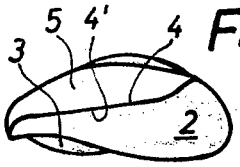
Fig.4
Fig.1
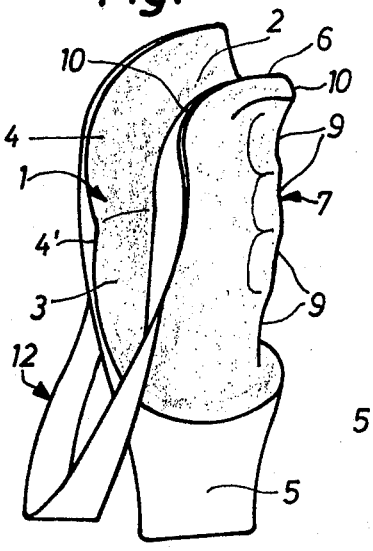
Fig.2
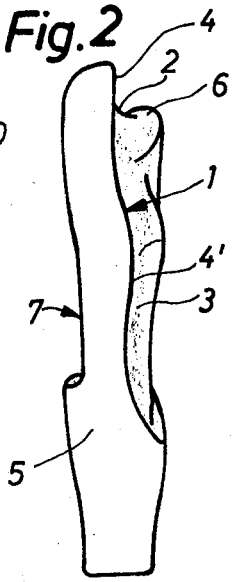
Fig.3
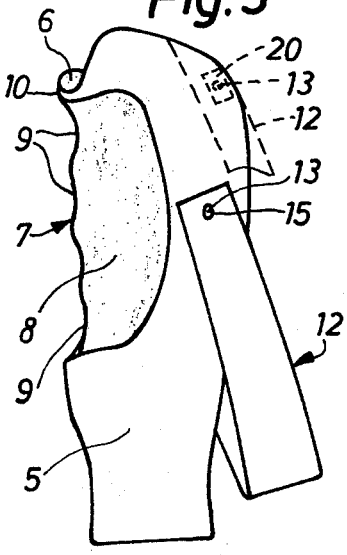

SKI POLE HANDLE OR THE LIKE

BACKGROUND OF THE INVENTION

The present invention relates to a new and improved construction of handle or handgrip for a pole or the like, especially a ski pole, the handle comprising a guide surface for the thumb, the metacarpus (hereinafter simply conveniently referred to as the palm of the hand) and the fingers.

Although as a matter of convenience in the discussion the handle of this development will be described in conjunction with its preferred use for a ski pole, it should be readily apparent that the use thereof is not strictly limited to this environment, but where otherwise possible can be used as the handle for other types of poles or the like. Hence, the term or expression "handle for a ski pole", or equivalent or like meaning terminology, is not to be construed in a limiting sense as used herein.

The conventional handles for ski poles are constructed such that they can be grasped at one side by the thumb and at the other side by the remaining fingers or digits. Consequently, the thumb and the fingers are located to different sides of the handle or handgrip. When the ski pole becomes stuck in the snow or otherwise during poling while skiing, typically when skiing around curves or when taking a fall, often times the thumb becomes jammed or subjected to crushing injuries due to the fact that the thumb is held back by the handle. Also there can arise shoulder injuries if the entire hand and thus the arm is restrained by the handle of a ski pole which suddenly becomes stuck. This can be explained in the following manner: When taking a fall the hand opens with a reflex movement i.e. instinctively. In particular, the thumb tends to spread away from the hand. The stuck handle exerts a reaction force upon the arch or dome portion between the fingers and the thumb, so that the latter is thrown out of joint.

SUMMARY OF THE INVENTION

Hence, it is a primary object of the present invention to provide a new and improved construction of handle for a pole, especially a ski pole, which is not associated with the aforementioned drawbacks and limitations of the prior art constructions.

Still a further and more specific important object of the present invention aims at constructing a handle or the like for a ski pole in a manner appreciably reducing the danger of the aforementioned jamming or injuries, if not in fact in many cases considerably eliminating the likelihood of such arising.

Yet a further object of this invention concerns a new and improved construction of handle which is not only relatively simple and inexpensive to manufacture, attractive in appearance, but has an anatomically correct construction which at least safeguards the user against injuries of the type discussed above.

A further object of this invention relates to a novel construction of a ski pole handle which at least considerably reduces the likelihood of there occurring the aforementioned type of injuries to the user.

Now in order to implement these and still further objects of the invention, which will become more readily apparent as the description proceeds, the handle of this development is manifested by the features that the guide surface embodies a substantially upright wall extending approximately in the lengthwise direction of the handle and essentially in an axial plane or a plane substantially in parallelism with such axial plane. This wall hinders the thumb from grasping around the handle and retains the thumb together with the palm and the base of each finger (sometimes referred to hereinafter as finger bases) at one side of the handle.

With the handle construction of the invention, the substantially vertical or upright wall serves to beneficially hold the thumb and finger bases at one side of the handle. Since the thumb thus does not grasp about the handle it no longer can become caught on the handle if the ski pole suddenly becomes stuck when skiing in curves or when taking a fall. By virtue of the fact that the thumb and fingers are located to one side there is insured, in any case, that when encountering the aforementioned situations the hand inclusive of the thumb will be easily released from the handle. This is predicated upon the fact that when arranging the thumb and most of the remaining portions of the hand to one side of the handle the arm is shifted or offset with respect to the ski pole, so that the line of action of the inertia or mass force which is effective when taking a fall comes to lie adjacent the handle. The orientation of the wall of the guide surface extending essentially in an axial plane or in a plane substantially parallel thereto, and which during normal use is located approximately parallel to the direction of the arm, insures that the hand can slide off of the handle by means of such guide surfaces whenever there is effective such inertia force, without any part of the hand, such as the thumb remaining caught at the handle. The hand can be conveniently held on the handle merely with the aid of a conventional strap or loop which engages over the wrist, precluding or at least substantially minimizing the risk of injury.

According to a further feature of the invention the guide surface possesses a thumb trough or recess which extends by means of its terminal or end region over the top of the handle. This thumb trough or equivalent thumb-receiving structure advantageously is bounded at one side by the wall, preventing a sliding of the thumb to the other side of the handle. At the other side there is advantageously provided only a protuberance or extension of small height, over which the thumb can easily slide when there is effective an inertia force between the hand and the handle and which prevents any too easy sliding-out of the thumb from the thumb trough or recess. However, neither such protuberance or thumb trough is absolutely necessary; the thumb could, for example, also support itself at the first joint of the index finger if the hand is supported at other locations on the handle, for instance on the narrow side with the index finger. Such support is contemplated as an augmentary feature to the thumb trough in accordance with a preferred embodiment of the invention.

The guide surface additionally can possess a ball trough or the like for supporting the ball of the thumb which advantageously merges at the top thereof with the thumb trough.

Advantageously there is provided at the other side facing away from the guide surface the major portion of a finger trough or the like, which according to a preferred embodiment merges with the ball trough at the other side of the handle.

It is preferred to provide a handle which is equipped with a holding strap or loop, and specifically for the following reasons: Since, according to the invention, the line of action of an inertia force or mass force or the like which is effective between the hand and the handle or handgrip is located adjacent the handle a rotational moment is exerted by the holding strap wrapped around the hand or wrist, respectively, which strives to turn the handle away from the hand. This moment of rotation enhances the desired release of the hand from the handle when such, in particular the pole, becomes stuck or otherwise hindered from moving. The lever arm at which there is effective the inertia force can be increased in that at least one end of the holding loop is arranged at the side of the handle facing away from the guide surface or guide surface means. However, it is advantageous if the other end of the holding loop or strap is arranged at the side of the handle provided with the guide surface in order to facilitate the insertion of the hand into the holding strap.

BRIEF DESCRIPTION OF THE DRAWING

The invention will be better understood and objects other than those set forth above, will become apparent when consideration is given to the following detailed description thereof. Such description makes reference to the annexed drawing wherein:

FIG. 1 is a side view of a handle or handgrip contemplated for use with a ski pole and constructed according to the teachings of the invention including a showing in plan view of the guide surface or guide surface means thereof;

FIG. 2 is a rear view of the handle, but omitting the showing of the holding strap or loop to simplify the illustration;

FIG. 3 is a side view of the handle portrayed in FIGS. 1 and 2, but illustrating the same from the side opposite that shown in FIG. 1;

FIG. 4 is a plan view of the handle of FIGS. 1 to 3, omitting the illustration of the holding strap to simplify the drawing;

FIG. 5 is a perspective view of the handle portrayed in FIGS. 1 to 4 showing the same from the side illustrated in FIG. 1, and illustrating in phantom view the hand holding such handle or handgrip; and FIG. 6 is a perspective view of the handle or handgrip shown in FIGS. 1 to 5, portraying the same in a view looking at an inclination from above and from the side of FIG. 3, again illustrating in phantom view or with phantom lines the hand holding the handle.

DETAILED DESCRIPTION OF THE INVENTION

Describing now the drawing, the handle or handgrip for a pole, especially a ski pole, embodies a handle proper or body having a guide surface or guide surface means designated in its entirety by reference character 1. This guide surface 1 extends approximately in the lengthwise direction of the handle and essentially in an axial plane containing the lengthwise axis of the ski pole or in a plane at a small spacing therefrom and in parallelism therewith, as best understood for instance by referring to FIG. 2. It will be appreciated that guide surface 1 is however not flat or planar, rather at its top or upper region possesses a thumb trough or recess 2 or equivalent structure and merging therewith at the bottom thereof a ball trough 3 or the like. Both of these troughs 2 and 3 are bounded by an upright or substantially vertical wall 4, the edge of which formed by the body 5 of the handle has been designated by reference character 4' in FIGS. 1, 2, 4 and 5. The wall 4 and the edge 4' prevent grasping the handle by means of the thumb.

The thumb trough 2 extends over the top of the handle and is limited or bounded at one side by the wall 4 and at the other side by a slightly raised extension or protuberance 6 in such a manner that the thumb can be comfortably placed into the trough 2 without, however, being appreciably hindered by the protuberance 6 from sliding-out of the trough 2. The ball trough 3 and the thumb trough 2 merge at their lower ends with a finger trough 7 or equivalent structure. This finger trough 7 extends about the front of the handle, but its major portion 8 however is located at the other side of the handle. The finger trough 7 possesses recesses or serrations 9 or equivalent structure for conveniently receiving the individual fingers. The uppermost recess or depression 9 of the finger trough 7 is separated by a web 10 from the thumb trough 2.

One end 11 of a holding strap or loop 12 or equivalent structure is secured in the thumb trough 2, the other end of which is attached to a lower situated portion or location 13 of the handle at the other side thereof.

By referring to FIGS. 5 and 6 it will be particularly apparent that the handle fits snugly and comfortably in the hand of the user due to the proper anatomical construction of such handle. The thumb and the finger bases are located at the side of the handle provided with the guide surface 1. Whenever there is effective an inertia force between the hand and the handle the latter does not provide any appreciable resistance to release of the hand owing to the orientation of the guide surface 1 essentially parallel to the line of action of the force. By means of the holding strap 12 the wrist exerts a moment which is produced by virtue of the inertia force, this moment striving to turn or rotate the handle away from the hand. Consequently the thumb slides over the protuberance 6 without any appreciable restriction or blocking action, while the thumb ball slides along the ball trough 3, so that there no longer exists the danger of becoming caught or stuck and hence there is precluded or substantially minimized the danger of jamming or crushing the thumb. There is also suppressed the possibility of suddenly transmitting to the shoulder of the user the reaction force of the stuck handle, so that also in this case there no longer exists —or at least there is appreciably minimized— the danger of injury.

From the drawing it will be apparent that the handle, apart from its configuration determined by the intended functions, also posssesses an aesthetic form.

The described and illustrated handle can be mounted on every type of ski pole.

Although the handle has been described (as mentioned above) for use by way of example in conjunction with a ski pole, other fields of use are of course contemplated whenever there should be prevented or reduced the undesired effects, arising upon sudden obstruction of the handle during its movement, upon the thumb, hand or shoulder of a person holding the handle or handgrip.

Due to the particular construction of the handle such possesses at its upper end a relatively large rounded surface, thereby reducing the possibility of blow injuries to the body of the user.

By virtue of the anatomically-correct configuration or construction of the handle, upon grasping the same, the cooling surface i.e. the surface of the hand exposed to cooling effects, is smaller than present with heretofore known prior art handles.

According to a further schematically illustrated aspect of the invention the one attachment location 13 —which incidentally could include releasable attachment means, generally indicated by reference character 15 for disconnecting the holding strap 12— for the holding loop 12 could be shifted further upwards and provided at the lateral region of the upper end of the handle, as shown in phantom lines in FIG. 3. Paticularly in the case of this modification the connection between the holding strap 12 and the handle at the lateral connection or attachment location 13 is constructed to be releasable, as indicated by the schematically portrayed strap release means 20 which are normally used in the art, so that the holding strap can be suspended via an elastic portion at the handle. Upon exceeding a certain force exerted by the hand upon the holding strap then the holding strap releases from its upper attachment location or attachment means 20.

While there is shown and described present preferred embodiments of the invention, it is to be distinctly understood that the invention is not limited thereto, but may be otherwise variously embodied and practiced within the scope of the following claims. ACCORDINGLY,

What is claimed is:

1. A handle for a pole, especially a ski pole, comprising an elongated body member having upper and lower ends and two substantially upright hand-engaging surfaces extending between said ends and formed on generally opposed sides of said body member, said upright surfaces extending approximately in the lengthwise direction of said body member and substantially parallel to the longitudinal axis thereof, one of said upright surfaces being configured to accomodate the distal end portions of the fingers of the user and the other upright surface being configured to accomodate the palm and the bases of the fingers of the user, said body member also defining a thumb resting surface formed on said upper end of the body member and on the same side of the body member as said other upright surface and merging with said other upright surface for accomodating the thumb of the user, and an upright wall formed on the same side of said body portion as said one upright surface and extending above said thumb resting surface to prevent the thumb from moving from said thumb resting surface towards said one upright surface.

2. The handle as defined in claim 1, further including a holding strap and means for connecting the holding strap to said body member.

3. The handle as defined in claim 2, wherein said holding strap includes at least one end arranged at the side of the body member opposite from said upright wall.

4. The handle as defined in claim 3, wherein the holding strap has a further end opposite said one end, said further end being arranged at the side of the body member provided with said upright wall.

5. The handle as defined in claim 2, wherein said connecting means includes means for releasably connecting the holding strap at a predetermined location with respect to said body member.

6. The handle as defined in claim 1 wherein said upright surfaces have recesses formed therein for accomodating the fingers and palm of the user.

7. The handle as defined in claim 1, wherein said other surface and said thumb resting surface are positionally oriented in such a manner that they do not produce any appreciable resistance to release of the hand of the user from the handle when there occurs an inertia force between the hand and the handle.

8. The handle as defined in claim 1, further including a horizontally extending web for separating said thumb resting surface from said one upright surface.

* * * * *